United States Patent [19]

Coxsey

[11] 4,287,963

[45] Sep. 8, 1981

[54] SAFETY APPARATUS

[76] Inventor: Darrell W. Coxsey, Rte. 2, Pilot Point, Tex. 76258

[21] Appl. No.: 113,976

[22] Filed: Jan. 21, 1980

[51] Int. Cl.[3] ..... A62B 1/12

[52] U.S. Cl. ..... 182/231; 182/236

[58] Field of Search ..... 182/5, 6, 7, 70, 71, 182/72, 73, 74, 75, 76, 3, 19, 231, 236, 238

[56] References Cited

U.S. PATENT DOCUMENTS

| | | | |
|---|---|---|---|
| 382,862 | 5/1888 | Blom | 182/74 |
| 1,162,679 | 11/1915 | Boufford | 182/238 |
| 1,233,540 | 7/1917 | Astaritas | 182/171 |
| 2,553,090 | 5/1951 | Holley | 182/238 |
| 2,873,055 | 2/1959 | Hill | 182/19 |
| 3,844,377 | 10/1974 | Wilkins | 182/6 |
| 3,850,263 | 11/1974 | Chin | 182/5 |
| 3,861,496 | 1/1975 | Hoover | 182/73 |
| 3,880,255 | 4/1975 | Huntley | 182/5 |

*Primary Examiner*—Reinaldo P. Machado
*Attorney, Agent, or Firm*—Wofford, Fails & Zobal

[57] ABSTRACT

Safety apparatus for lowering one or more persons from a window or a hotel room or the like characterized by structural framework that is affixed inside the room and disposed adjacent the window, an extensible arm that is pivotally connected with the structural framework and having a free end that is pivotally moveable exteriorly of the window, a rotating drum having a lineal member disposed thereabout and connected therewith for controllably dispensing the member and any person at the end of the lineal member, sheaves suitably mounted with the lineal member traversing thereover, body harness means for holding the person or persons and connected with the lineal member, such as the cable, and means for controlling the rate of descent of the person without requiring a separate control cable, radio control with elaborate receiving equipment inside the room or the like.

5 Claims, 5 Drawing Figures

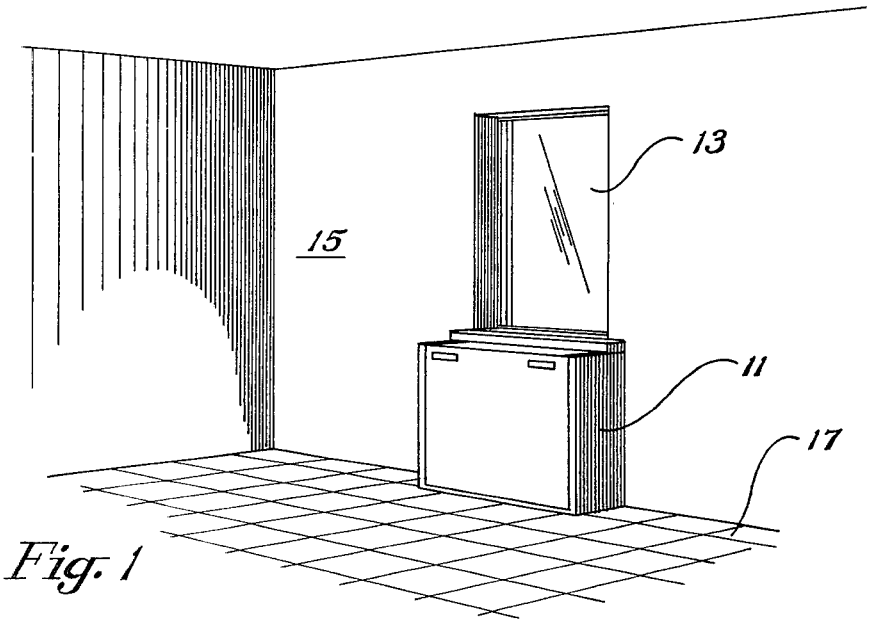
Fig. 1
Fig. 2
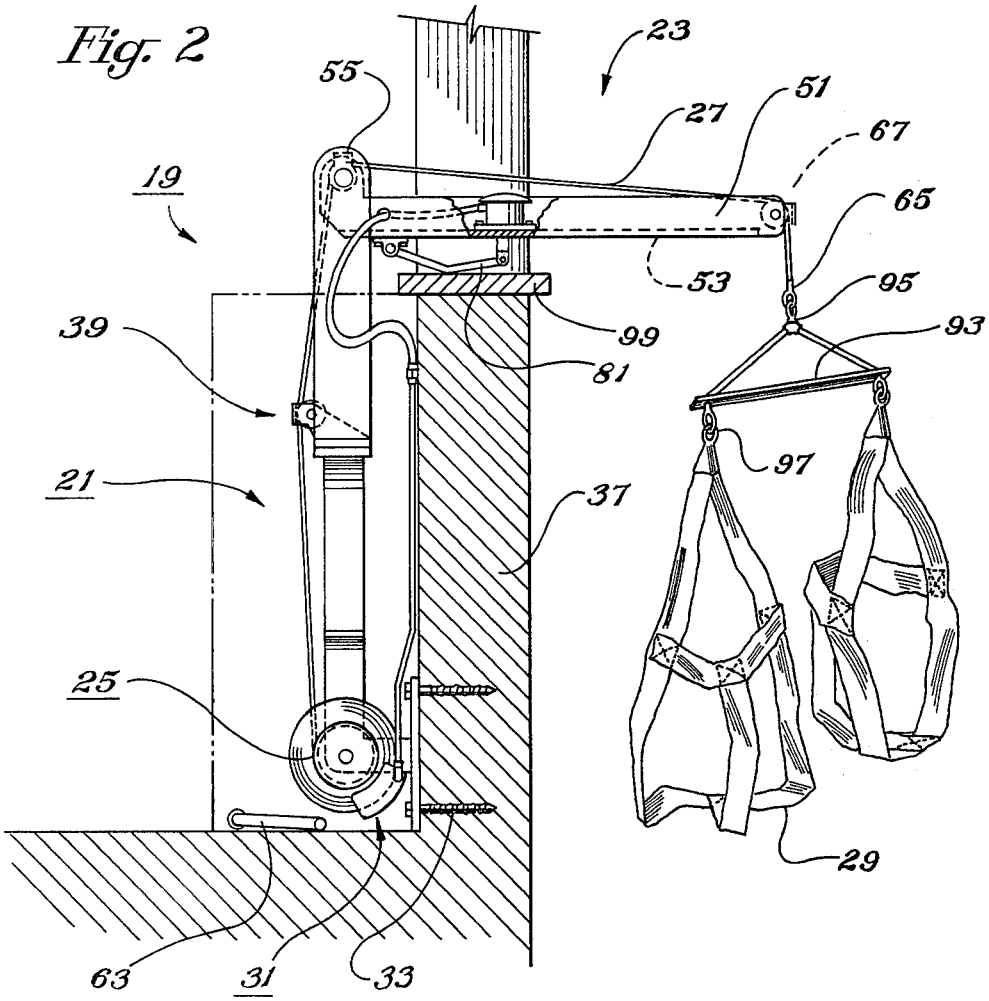

SAFETY APPARATUS

FIELD OF THE INVENTION

This invention relates to safety equipment such as employed for allowing emergency egress from a hotel room or the like. More particularly, this invention relates to the safety equipment for lowering one or more persons from a window in a hotel room, as in the case of fire or other such emergency.

DESCRIPTION OF THE PRIOR ART

As real estate gets more valuable in a metropolitan area, there is a greater tendency for buildings such as hotels, office buildings and the like to rise vertically rather than take up more space horizontally. With this rise in vertical height, there becomes an increasing problem of safety in the event of emergency. Specifically, in the event of an emergency such as a fire in the building, how are the occupants to escape if the elevators and fire escapes are blocked?

The prior art has seen a wide variety of different types of apparatuses employed and advocated for this purpose. Typical are the following U.S. patents. U.S. Pat. No. 1,162,679 describes a fire escape comprising a vehicle that is moved to the window with a part passed out for escape. A device is provided for controlling the speed of descent via cable. Gear wheels with means for controlling the rotation rate of a drum comprise a pneumatic ram with a limited escape of air. U.S. Pat. No. 2,553,090 describes a fire escape mechanism with the drum and hydraulic governor therefor employing a paddle and viscous liquid in an enclosed reservoir for allowing the emergency escape. U.S. Pat. No. 2,873,055 discloses a fire escape drum wherein a braking action is proportional to the rate of descent and uses a pump to generate pressure against a piston acting to apply the brake. U.S. Pat. No. 3,844,377 is substantially the same although the escapees are lowered by electric motor with a remote control 66 to allow remote control by way of a box 63. U.S. Pat. No. 3,850,263 describes apparatus in which escape is provided with a winch and grooved rotor moving a piston to apply hydraulic pressure as fall is experienced. The operation of this is to start, stop, release and start to fall again; and then, stop, start, and repeat the process. U.S. Pat. No. 3,861,496 describes escape apparatus in which the rotation of a winch reciprocates pistons by way of cams. Liquid flows against a restricting means to effect braking action. U.S. Pat. No. 3,880,255 shows an escaper with harness and a cannister containing a cable. Playout of cable from the cannister allows control of the lowering.

As can be seen from the foregoing, there is a large body of art in this area of relatively crowded technology. All of the prior art apparatuses, however, have been complex with remote control requirements or the like; have been disruptive of decor; or have had the cable in the cannister so that the weight of the cable increased the suspension requirements and required active play out of the cable by the escapee.

SUMMARY OF THE INVENTION

Accordingly, it is an object of this invention to provide a simple, relatively economical apparatus that can be affixed in the room without disrupting the decor of the room, yet provide a simple descent for emergency escape without requiring remote control or without requiring the occupant to carry a large cannister of cable with him or her when leaving the room in an emergency.

It is a specific object of this invention to provide a simple apparatus with which a window can be broken without auxiliary tools other than a portion of the apparatus and allow the occupant to escape from the window in the event of an emergency and wherein the braking is proportional to the weight of the occupant seeking to escape.

These and other objects will become apparent from the descriptive matter hereinafter, particularly when taken in conjuction with the appended drawings.

In accordance with one embodiment of this invention, there is provided safety apparatus for lowering at least one person from a window of a hotel room or the like comprising:

a. structural framework that is affixed interiorly of the room and disposed adjacent the window;
b. extensible arm pivotally connected at one end with the structural framework and having a free end pivotally moveable exteriorly of the window;
c. rotating drum means journalled in the structural framework for rotation and controllably playing out a lineal member for lowering the person;
d. lineal member disposed about and connected with the rotatable drum means;
e. at least one sheave mounted at the free end of the arm and having the lineal member traversing thereover;
f. body harness means for holding a person; the body harness means being connected with the lineal member so as to support the weight of the person; and
g. means for controlling the rate of rotation of the rotatable drum means and hence the rate of descent of the person.

The rate of rotation of the drum means is controlled proportional to the weight of the person so as to effect a constant rate of descent regardless of the weight of the person.

BRIEF DESCRIPTION OF DRAWINGS

FIG. 1 is a partial perspective view of a room showing a window and the safety apparatus of this invention.

FIG. 2 is a side elevational view, partly in section showing the safety apparatus of FIG. 1 with a pivotal arm pivoted exteriorly of the window.

DESCRIPTION OF THE PREFERRED EMBODIMENTS

It is to be borne in mind that this invention may be useful in a wide variety of applications in which an occupant, permanent or temporary, finds himself at a height above a surface and needs to escape in the event of an emergency. This is best typified by an occupant of a hotel room, office or the like in a high rise building and it is in this enviroment that this invention will be described hereinafter.

Referring to FIG. 1, the apparatus is housed within a cabinet 11 adjacent a window 13 of a room 15. As illustrated, the cabinet 11 sits on a floor 17.

Figure 3:
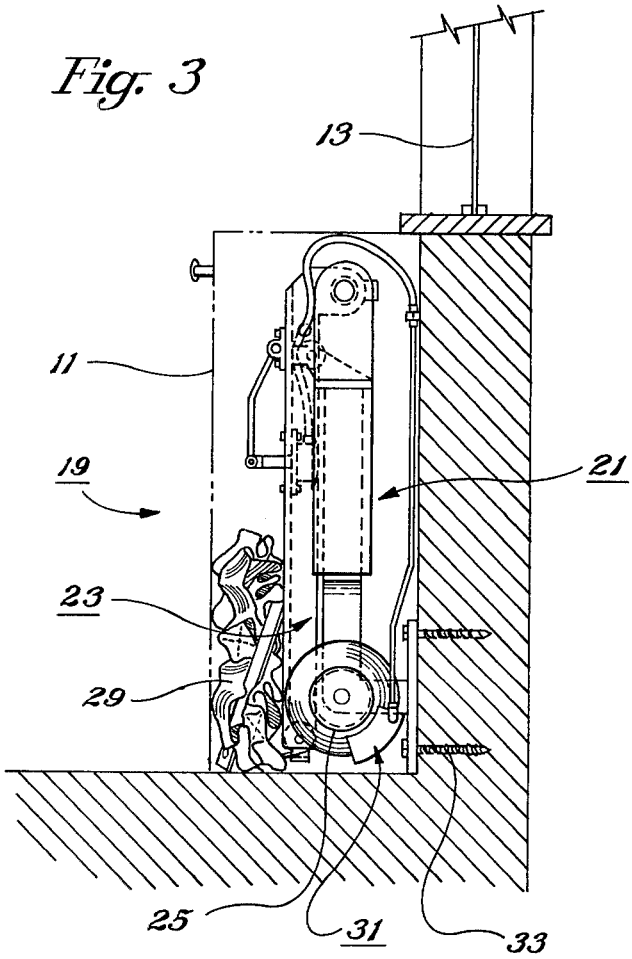
FIG. 3 is a side elevational view, partly in section of the cabinet, of the safety apparatus of FIG. 2 in the stored position.
Figure 4:
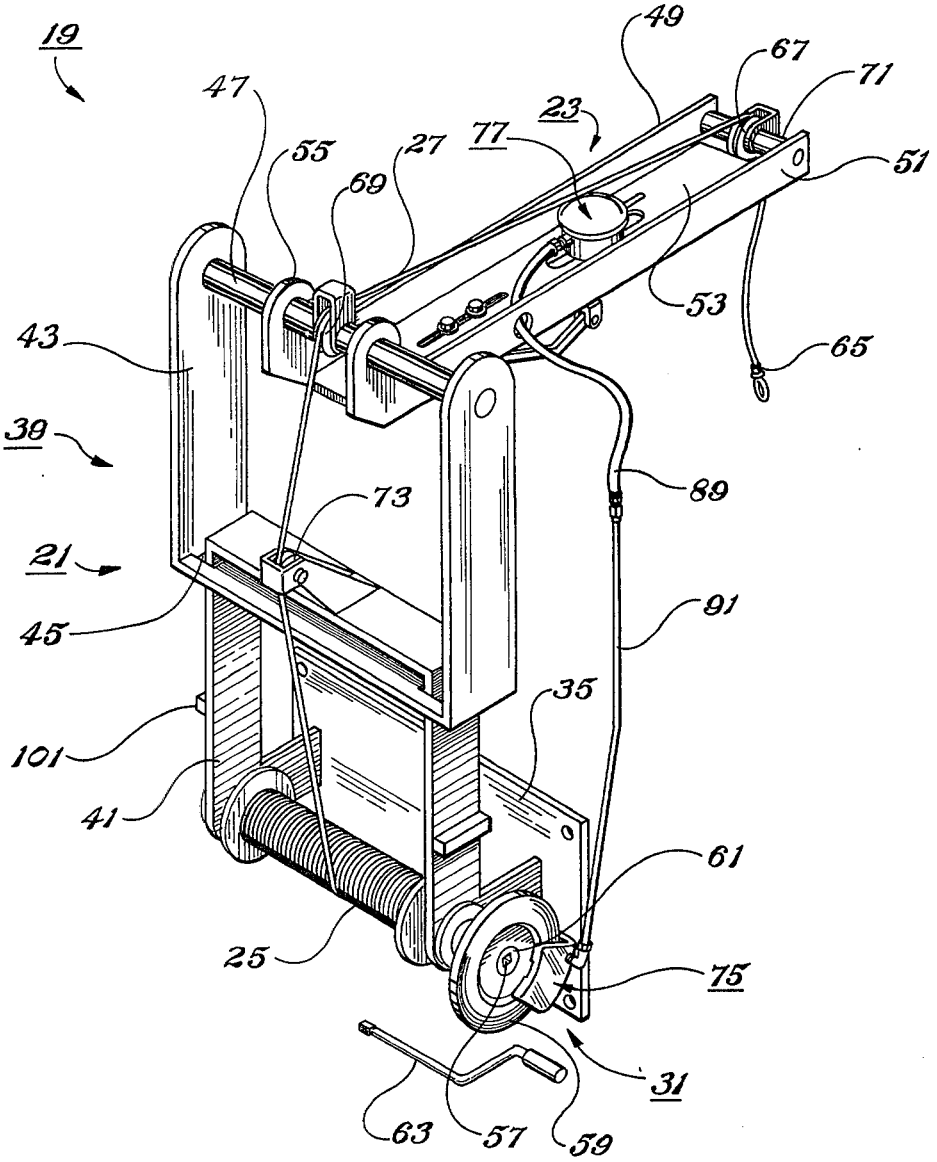
FIG. 4 is an isometric view of the safety apparatus of FIG. 2.

Referring to FIGS. 2–4, the apparatus 19 includes a structural framework 21, an extensible arm 23, a rotatable drum means 25, a lineal member 27, a body harness means 29 and a means 31 for controlling the rate of rotation of the drum means and hence the rate of descent of a person in the harness 29.

The structural framework 21 is affixed interiorly of the room and disposed adjacent the window 13. As illustrated the structural framework 21 is connected into the wall, as by long screws 33, FIGS. 2 and 3. As can be seen from the base plate 35, FIG. 4, there are four apertures for receiving the screws 33 for fixedly engaging the wall 37. The structural framework may take any form as long as it is structurally adequate to support the weight of one or two persons being lowered from the window 13.

As illustrated, the structural framework 21 includes an upwardly extensible means 39 for raising the extensible arm 23 above the bottom of the window for exending the arm 23 exteriorly of the room 15. Specifically, a bottom U-bracket 41 is affixed, as by welding, to the base plate 35 and slidably engages a top U-bracket 43 by way of apertures 45. In this way, the rotatable arm 23 can be pivoted interiorly of the room and the top U-bracket 43 slid downwardly so that the entire apparatus 19 will rest within the cabinet 11. When it is desired to extend the arm 23, the arm 23 is pivoted through the window; after raising the window, or after breaking the window. The pivoting of the arm 23 raises the top U-bracket 43 to the stop.

The structural framework 21 may be formed from any material that will have adequate structural strength, as indicated. Preferably, it is formed of steel members for economy and strength. If desired, of course, it can be fabricated from aluminum or even more exotic metals, such as magnesium, titanium or the like. Steel is easily welded, machined and otherwise worked, so it is preferred for holding the arm 23.

The arm 23 is journalled, as by way of the shaft 47, in the structural framework for pivotal movement between the stored and extended positions. Specifically, the shaft 47 is affixed by suitable means, such as bearings, nuts, or being bradded into apertures in the structural framework so as to hold the arm 23. The shaft may be rotatable within the structural framework, or the arm may be rotatable about the shaft 47. In any event, the arm 23 has adequate structural strength to hold the number of persons for which there are body harnesses 29. As illustrated, there are two, so the structural strength of the arm must be adequate to hold at least 400 pounds. Of course, the design may hold more or less as desired depending upon the designs needed. As illustrated, the arm 23 comprises a U-channel or the like, including two members 49, 51 and plate 53. Each of the members 49 and 51 are pivotally connected by way of the brackets such that the arm can be pivoted to place its free end, respectively, interiorly and exteriorly of the window 13. This allows the arm to support one or more sheaves for running thereover the lineal member from the rotatable drum means 25.

Rotatable drum means 25 is journalled in the structural framework for rotation and for controllably playing out, or dispensing, a lineal member for lowering the person. The rotatable drum means 25 may comprise any rotatable drum means having the desired structural strength. As illustrated, it is a cable drum formed of steel or the like and having wrapped around it the lineal member 27. Specifically, the cable drum 25 is mounted on a shaft that is journalled in bearings in the lower U-frame 41 for rotation. The drum means 25 is physically connected with the shaft 57 to which is affixed a fly wheel 59 for braking or the like. In addition, the shaft 57 has a key way slot 61 for receiving a crank 63 for rewinding the cable 27 onto the drum 25 following its use.

The lineal member is disposed about and connected with the rotatable drum means. The lineal member 27 may comprise any adequately strong and flexible member that will support the weight of the one or more persons. For example, it can be Nylon rope, hemp rope, cable or even a chain if sprockets are used for the sheaves. As illustrated, the linear member 27 comprises steel cable. The steel cable is preferred, since it resists burning or melting or being cut by a contact with sharp edges or the like as would Nylon rope. The lineal member has at its free end an eye 65 for connecting with the harness means 29 for supporting the persons. It traverses over a plurality of sheaves 67, 69.

The sheaves 67 and 69 will take any form appropriate to the form of the lineal member. For example, they may be simply pulleys with a V shaped path over which the cable 27 traverses as the person is lowered, the sheaves rotating freely about their respective shafts 47 and 71. On the other hand, the sheaves 67, 69 have the form of sprocket wheels or the like if chains are employed as the lineal member. As illustrated, the sheave 67 is located at the free end of the arm 23 while the sheave 69 is located at the shaft 47, of the pivotally connected end of the arm 23. It will be apparent, of course, that additional sheaves such as the idler sheave 73 can be employed to maintain free run of the lineal member 27. On the other hand, if the rotatable drum means 25 is located at the top of the structural frame work, only the sheave at the outer end of the free arm is necessary.

The body harness means 29 may comprise any of the harnesses for holding the one or more persons for the descent. The body harness means 29 may be comprise elaborate parachute type harness that is fastened about the body and straps tightened so that the body is prevented from falling out even if there should be unconsciousness. On the other hand, it is ordinarily not necessary for such elaborate body harness and a simple combination of straps can be fitted about the torso of the person and rely on the person being conscious to hold into the harness is adequate. The body harness is ordinarily formed of structurally strong material that is still flexible to accomodate any shape body ranging from a small child to a large adult. Typical of this is Nylon webbing sewed with strong Nylon thread, silk thread or the like. If desired, reinforcing can be provided by brads. As indicated, suitable buckles or straps can be employed to further assist in providing a body harness that will retain the person regardless of the rate of descent.

Figure 5:
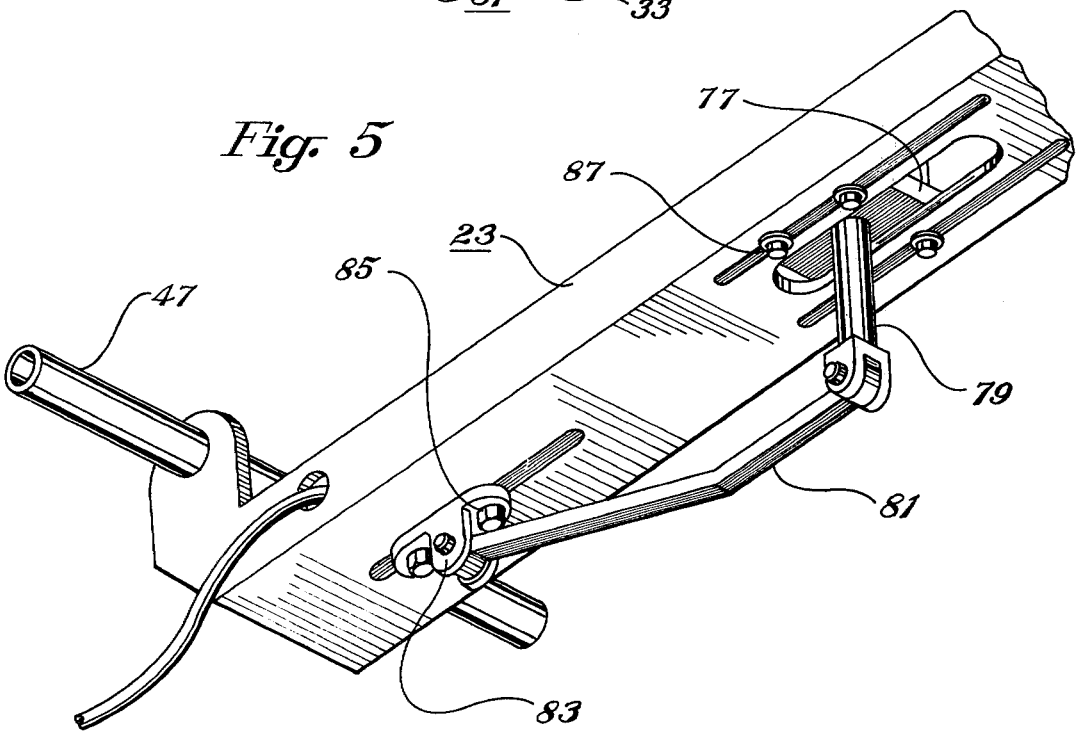
FIG. 5 is a partial isometric view of the brake applying means of the safety apparatus of FIG. 2.

The means 31 for controlling the rotational rate of the drum means and, hence, the rate of descent may comprise any of the structures that will provide a braking force proportional to the weight of the person or persons being lowered. As illustrated, the means 31 for controlling the rate of rotation comprises a brake means 75 and brake applying means 77 on the arm 23 that are connected for applying a braking force proportional to the weight of the person being lowered. Specifically, the brake means 75 comprises, in the illustrated embodiment, a hydraulic means for applying the braking force. The braking means may be a brake shoe applying force to a brake drum or, as illustrated, a disc brake for applying a force to the fly wheel 59. The brake applying means 77 comprises a conventional hydraulic brake cylinder and ram that is mounted on the arm 23 for applying the braking force as the arm is laid across the window sill or the like. Specifically, the brake shaft 79, FIG. 5, is moved upwardly relative to the arm 23, responsive to a force on the pivotally mounted brake arm 81. As can be seen, the hydraulic brake applying means 77, the shaft 79, the brake arm 81 and its pivotally mounting bracket 83 may be adjusted longitudinally of the arm 23 by loosening the fastening means; such as the nuts 85, 87; to allow adjustment to hit the window sill for the given installation when the arm 23 is pivoted outwardly about its shaft 47.

The brake applying means 77 is connected with the brake means 75 by suitable hydraulic conduit inclusive of flexible tubing 89 and relatively inflexible tubing 91. The flexible tubing 89 is of such length and sufficient flexibility as to accomodate the pivotal movement of the arm 23 and the resulting pivotal movement of the brake applying means 77, yet transmit the hydraulic pressure and hence the braking force to the brake means 75. The brake applying means and the brake means 77, 75 are so designed as to apply a braking force proportional to the weight on the lineal member 27. For example, if a person weighting 180 pounds is lowered in the harness 29, a braking force is applied of 180 pounds. This achieves an equilibrium that prevents too rapid a rate of descent as would occur with an unbalanced force. There is a compensating effect in that as more cable is played out lowering the person, the weight tends to increase slightly, but is off set by the decreasing radius of the rotatable drum means 25. Thus ideally, the person leaves the window and travels from the window to the surface therebelow at a constant rate. In the event that there is a slight imbalance and the person begins to slow down in the rate of descent and even comes to a stop, the person can push themselves downwardly by pushing on the side of the building adjacent which they are making their descent. Conversely, if they wish to slow their rate of descent slightly they can take advantage of the side of the building, including window ledges and the like to add a frictional force opposite the rate of descent and obtain whatever velocity they desire. If unloading of the braking force is sufficient, as by standing on a window sill, a temporary increase in downward velocity can be achieved because of the decreased braking force. Thus, the person making their descent has a good deal of flexibility in controlling the rate of descent. The easiest way to have the braking force the same as the weight of the person on the cable 27 and hence on the free end of the arm 23 is by adjusting the size of the rams in the respective hydraulic cylinders and the brake means and the brake applying means 75, 77 until the desired braking force is applied to the fly wheel 59. There is a propensity to err on the side of safety in applying too much braking force, because of the fear of falling that most people have. Thus an initially rapid rate of descent is scarey so the designer is prone to apply too great a braking force too early. This is safe in buildings of only a half a dozen stories or so. It is fortuitous that it can be compensated for in higher buildings by the person applying successive upward or downward forces, as by kicking off of window sills, jumping in the harness and the like which alternately applies and releases the braking force and allows a descent, even if the velocity be somewhat erratic if too much braking force is applied. Ordinarily, even if slightly too little braking force is applied, the friction of the rotation through the respective sheaves, journals, bearings and the like will prevent the rate of descent from being unsafe.

If desired, a capillarcy or other slow restrictor can be employed to slow down the rate of application of the braking force, alone or with more elaborate relief and reinforcement pressure means. The latter is, however, ordinarily unnecessary and adds to the expense.

In operation, the apparatus 19 is stowed in the cabinet 11 as shown in FIG. 1. At the time of an emergency, as in a case of fire or the like the cabinet door is opened and the free arm 23 has its free end extended outside the window. If necessary, the glass in the window 13 can be broken by the steel arm 23. The occupant dons the harness 29. As illustrated, there are a pair of harnesses suspended from a double tree 93, FIG. 2. The double-tree is suspended from the eye 65 by appropriate means, as by having a steel fastener snapped thereinto, having a cable looped through and threaded back into the Y 95 or the like. The shoulder harnesses 29 are fastened similarly by way of eyes 97. Thereafter, the person lowers himself over the window sill with the brake arm 81 engaging the sill 99 for applying the braking force responsive to the weight of the occupant. After insuring that the cable 27 is over the respective sheaves, such as sheaves 67, the person begins the descent. The weight on the end of the arm applies a braking force equal to the weight of the person. Consequently, the descent is uniform at the rate initially imparted by the person. As indicated hereinbefore, if the person wishes to speed up the descent the person may do so by imparting additional forces along side of the building. Conversely if the person wishes to slow the rate of descent he may apply the opposite force along the side of the building. When the person reaches safety, he escapes readily from the body harness 29.

After the descent and the emergency is over, the cable drum 25 is rewound by crank 63.

If the window sill is higher than the shaft 47 when the upper U-bracket 43 is bottomed out against stops 101, the upper bracket 43 is raised upwardly until the brake arm 81 rests on the sill 99 or the window. Preferably the heights are coordinated such that the extensible means 39 is at its maximum when the arm is level. Otherwise, moment distances have to be such that the structural framework remains in equilibrium by having the force tending to move the upper U-bracket 43 upwardly countered by tension along the cable 27.

While the structural framework is illustrated as having been affixed by screws as in retro-fitting an existing room, it is preferably affixed during new construction. This may be done effectively by welding to reinforcing steel members or the like.

From the foregoing it can be seen that this invention achieves the objects delineated hereinbefore. This invention is particularly efficacious in high-rise buildings that do not have an exterior fire escape means.

Although the invention has been described with a certain degree of particularity, it is understood that the present disclosure is made only by way of example and that numerous changes in the details of construction and the combination and arrangement of parts may be resorted to without departing from the spirit and the scope of the invention, reference for the latter purpose being had to the appendend claims.

I claim:

1. Safety window apparatus for lowering at least one person from a window of a hotel room or the like comprising:

a. structural framework disposed and affixed interiorly of the room and disposed adjacent the window;

b. extensible arm pivotally connected at its first end with said structural framework and having a free end that is pivotally moveable exteriorly of said window;

c. rotatable drum journalled in said structural framework for rotating and controllably playing out a lineal member for lowering the person;

d. lineal member disposed about and connected with said rotatable drum means;

e. at least one sheave mounted at the free end of said arm and having said lineal member traversing thereover;

f. body harness means for holding said person, said body harness means being connected with said lineal member; and g. means controlling the rate of rotation of said rotatable drum means and hence the rate of descent of said person; said means controlling the rate of rotation comprising a brake means;

said arm having a brake applying means for applying a braking force proportional to the weight of said at least one person being lowered by said lineal member from the end of said arm.

2. The safety apparatus of claim 1 wherein said apparatus is stored within a cabinet lower than said window and said structural framework includes an upwardly extensible means for raising said arm above the bottom of said window for extending said arm exteriorly of said room.

3. The safety apparatus of claim 2 wherein said rotatable drum is disposed adjacent the floor in said room and a second sheave is disposed adjacent the top of said extensible means; said second sheave having said lineal member traversing thereover.

4. The safety apparatus of claim 1 wherein said brake means comprises a hydraulically operated brake and said brake applying means comprises a hydraulic cylinder and ram with an actuating member for applying pressure via said hydraulic cylinder and ram; said hydraulic cylinder being fluidly connected with said brake means via hydraulic brake line.

5. The safety apparatus of claim 4 wherein said hydraulic brake line includes a section that is sufficiently long and flexible to allow pivotal movement and extension of said arm outside of said window.

* * * * *